US011808071B2

(12) United States Patent
Cai et al.

(10) Patent No.: US 11,808,071 B2
(45) Date of Patent: Nov. 7, 2023

(54) ANTI-DEFORMATION HINGE WITH PRELOAD ADJUSTMENT FUNCTION

(71) Applicant: QINGYUAN SACA PRECISION MANUFACTURING CO., LTD., Guangdong (CN)

(72) Inventors: Gengxi Cai, Guangdong (CN); Yitai Wu, Guangdong (CN); Wengen Zhu, Guangdong (CN); Xiaoqiang Che, Guangdong (CN)

(73) Assignee: QINGYUAN SACA PRECISION MANUFACTURING CO., LTD., Qingyuan (CN)

( * ) Notice: Subject to any disclaimer, the term of this patent is extended or adjusted under 35 U.S.C. 154(b) by 181 days.

(21) Appl. No.: 17/400,129

(22) Filed: Aug. 12, 2021

(65) Prior Publication Data

US 2021/0372179 A1 Dec. 2, 2021

Related U.S. Application Data

(63) Continuation of application No. PCT/CN2019/097777, filed on Jul. 25, 2019.

(30) Foreign Application Priority Data

May 4, 2019 (CN) ..... 201910377431.2

(51) Int. Cl.

| | |
|---|---|
| ***E05D 7/04*** | (2006.01) |
| ***E05D 5/02*** | (2006.01) |
| ***E05D 5/06*** | (2006.01) |

(52) U.S. Cl.
CPC ..... *E05D 7/0407* (2013.01); *E05D 5/0276* (2013.01); *E05D 5/065* (2013.01)

(58) Field of Classification Search
CPC ... E05D 11/1014; E05D 11/1021; E05D 7/00; E05D 7/0415; E05D 7/123; E05D 7/12;
(Continued)

(56) References Cited

U.S. PATENT DOCUMENTS 5,327,616 A * 7/1994 Lautenschlager ..... E05D 5/065 16/388
5,355,557 A * 10/1994 Cress ..... E05D 11/1014 16/335

(Continued)

*Primary Examiner* — Chuck Y Mah

(57) ABSTRACT

The invention provides an anti-deformation hinge with a preload adjustment function, comprising an outer fixing cup being hinged with the adjustment combination seat and opened or closed on an adjustment combination seat around a hinging position, the adjustment combination seat comprises an upper adjusting plate, a middle adjusting plate and a bottom adjusting plate. The upper adjusting plate is integrally formed with a crank hinged with the outer fixing cup. The upper adjusting plate is provided with an adjusting sliding connecting piece. The middle adjusting plate is provided with a preload lug, and the bottom adjusting plate is slidably arranged on the middle adjusting plate and is slidably connected with the preload lug. The hinge is simple in structure and has a preload adjustment function, improve the assembly accuracy, enhance the load-bearing strength, reduce the deformation probability, and increase the use stability of the hinge.

20 Claims, 12 Drawing Sheets

(58) Field of Classification Search
CPC ..... E05D 7/125; E05D 7/04; E05D 7/0407; E05D 7/0423; E05D 7/081; E05D 5/0276; E05D 5/065; E05D 2007/0492; E05D 3/142; E05Y 2600/502; E05Y 2600/51; E05Y 2600/626; E05Y 2800/178; E05Y 2900/20; E05F 5/006; E05F 1/1284; Y10T 16/5321; Y10T 16/5322; Y10T 16/53225; Y10T 16/53826; Y10T 16/5383; Y10T 16/53832
See application file for complete search history.

(56) References Cited

U.S. PATENT DOCUMENTS

| | | | | | |
|---|---|---|---|---|---|
| 5,621,947 | A * | 4/1997 | Fitz | E05D 7/0423 | 16/388 |
| 5,920,958 | A * | 7/1999 | Domenig | E05D 7/0423 | 16/245 |
| 7,117,561 | B1 * | 10/2006 | Domenig | E05D 7/0407 | 16/236 |
| 10,184,280 | B2 * | 1/2019 | Rahman | E05D 5/121 | |
| 10,619,390 | B2 * | 4/2020 | Suesada | E05D 5/062 | |
| 2002/0166209 | A1 * | 11/2002 | Cress | E05D 5/065 | 16/382 |
| 2007/0289094 | A1 * | 12/2007 | Lowe | E05D 5/08 | 16/238 |
| 2011/0035906 | A1 * | 2/2011 | Esaki | E05D 5/062 | 16/374 |
| 2015/0135479 | A1 * | 5/2015 | Salice | E05D 5/0276 | 16/236 |
| 2016/0208533 | A1 * | 7/2016 | Ng | E05D 7/0415 | |
| 2020/0173216 | A1 * | 6/2020 | Salice | E05D 5/08 | |
| 2021/0277698 | A1 * | 9/2021 | Capur | E05D 11/10 | |

* cited by examiner

ANTI-DEFORMATION HINGE WITH PRELOAD ADJUSTMENT FUNCTION

CROSS REFERENCE TO RELATED APPLICATIONS

The present application is a Continuation Application of PCT Application No. PCT/CN2019/097777 filed on Jul. 25, 2019, which claims the benefit of Chinese Patent Application No. 201910377431.2 filed on May 4, 2019. All the above are hereby incorporated by reference in their entirety.

FIELD OF INVENTION

The invention relates to the technical field of hinges, and particularly relates to an anti-deformation preventing hinge with a preload adjustment function.

BACKGROUND ART OF THE INVENTION

A hinge is mainly used for the opening or closing connection of a furniture board, and comprises an outer fixing cup installed on a door panel and an adjustment combination seat installed on a cabinet body, wherein the outer fixing cup is hinged with the adjustment combination seat and is opened or closed on the adjustment combination seat around a hinging position.

In order to effectively adjust an installation position of the hinge, a structure for adjusting a distance to the connection of the outer fixing cup is generally assembled on the adjustment combination seat to enhance operation stability and achieve simple operation.

However, the hinge of the above structure still has the following deficiencies in practical application:

1) The adjustment combination seat is composed of an upper adjusting plate, a middle adjusting plate and a bottom adjusting plate, each of the upper adjusting plate, the middle adjusting plate and the bottom adjusting plate of this combination seat is formed by punching a metal plate and subjected to metal conductance surface treatment, causing the tolerance deviation between connections thereof to be large, so shaking is easy to occur during operation of the plates, thereby causing noise, reducing the use stability of the product, and influencing the use quality.
2) The upper adjusting plate is provided with a crank hinged with the outer fixing cup by means of screws, and the upper adjusting plate is required to be punched to form a hollow part for sliding connection with the middle adjusting plate. When the hinge bears a heavy load, a side part of the upper adjusting plate may be deformed, so the upper adjusting plate and the crank are loosened, and then the door body is loosened during use and noise is generated, thereby influencing the use quality of the product.
3) When the hinge is opened or closed or an assembly position is adjusted, friction may occur between one plate and another plate of the adjustment combination seat, over time, it is easy to wear a connection between the plates, which may cause a large fit clearance between the plates, thereby causing the door body to loosen and influencing the use effect of the product.

DISCLOSURE OF THE INVENTION

The purpose of the invention is to overcome the defects of the prior art to provide an anti-deformation hinge with a preload adjustment function which is simple in structure and has a preload adjustment function to adjust the compactness and preload between plates of an adjustment combination seat, overcome dimension errors among components, improve the assembly accuracy, strengthen the load bearing strength, reduce the deformation probability enhance the use stability of the hinge and ensure the use effect of the product.

The purpose of the invention is achieved by means of following technical solution: an anti-deformation hinge with a preload adjustment function, comprising: an outer fixing cup and an adjustment combination seat, the outer fixing cup being hinged with the adjustment combination seat and opened or closed on the adjustment combination seat around a hinging position, wherein the adjustment combination seat comprises an upper adjusting plate, a middle adjusting plate and a bottom adjusting plate which are slidably connected in sequence, the upper adjusting plate is integrally formed with a crank hinged with the outer fixing cup, and the upper adjusting plate is provided with reinforcing bumps located at two sides of the crank and connected with the two sides of the crank;

the upper adjusting plate is provided with an adjusting sliding connecting piece for adjusting a compactness of connection between the upper adjusting plate and the middle adjusting plate, and the adjusting sliding connecting piece is arranged at a connection between the upper adjusting plate and the middle adjusting plate;

the middle adjusting plate is provided with a preload lug for adjusting a compactness of connection between the middle adjusting plate and the bottom adjusting plate, and the bottom adjusting plate is slidably arranged on the middle adjusting plate and is slidably connected with the preload lug.

According to the above optimization, the adjusting sliding connecting piece comprises open inclined through grooves and sliding blocks, wherein the open inclined through grooves are arranged at a left side and a right side of the upper adjusting plate, and the sliding blocks are arranged at a left side and a right side of the middle adjusting plate and are slidably connected to the open inclined through grooves along with a slip of the middle adjusting plate.

According to the above optimization, a width of the open inclined through groove is gradually narrowed in a direction approaching to the outer fixing cup.

Alternatively, the adjusting sliding connecting piece comprises inclined trenches and sliding blocks, wherein the inclined trenches are arranged at a left side and a right side of the upper adjusting plate, and the sliding blocks are arranged at a left side and a right side of the middle adjusting plate and are slidably connected to the inclined trenches along with a slip of the middle adjusting plate.

According to the above optimization, a width of the inclined trench is gradually narrowed in a direction approaching to the outer fixed cup.

According to the above optimization, an adjusting direction of the adjusting sliding connecting piece is consistent with a sliding direction in which the middle adjusting plate slides on the preload lug.

According to the above optimization, at least three preload lugs are integrally formed on an upper surface of the middle adjusting plate and each preload lug is provided with a preload inclined plane gradually inclined upwards from outside to inside, the bottom adjusting plate is provided with a sliding grommet, the sliding grommet is leftward or rightward connected to the middle adjusting plate slidably, and an upper inside surface of the sliding grommet is forward or backward connected to the preload inclined plane slidably.

According to the above optimization, a front inside surface of the grommet is provided with reinforcing lugs slidably connected to the middle adjusting plate, and corner parts at the left side and the right side of the middle adjusting plate are provided with reinforcing convex ribs.

According to the above optimization, the outer fixing cup is provided with a spring, an elastic part of the spring is sheathed on the outer fixing cup, both ends of the spring are respectively connected at a hinging position of the crank and the outer fixing cup, and the crank is provided with a reinforcing rib part extending from an upper end surface of the crank to an upper surface of the upper adjusting plate.

According to the above optimization, the middle adjusting plate is provided with a forward-backward adjusting piece for adjusting a forward or backward installation position of the upper adjusting plate and adjusting a slip position relative to the adjusting sliding connecting piece and the preload lug, one end of the forward-backward adjusting piece is eccentrically connected to the upper adjusting plate, and the other end of the forward-backward adjusting piece is positioned on and connected to the middle adjusting plate;

the middle adjusting plate is provided with a height adjusting piece for adjusting a height installation position of the upper adjusting plate, one end of the height adjusting piece is positioned on and connected to the upper adjusting plate, and the other end of the height adjusting piece is in threaded connection to the middle adjusting plate;

the middle adjusting plate is provided with a leftward-rightward adjusting piece for adjusting a leftward or rightward installation position relative to the bottom adjusting plate, one end of the leftward-rightward adjusting piece is eccentrically connected to the middle adjusting plate, and the other end of the leftward-rightward adjusting piece is positioned on and connected to the bottom adjusting plate.

The invention has the advantages that:

1) Under the action of the adjusting sliding connecting piece, the compactness and preload of connection between the upper adjusting plate and the middle adjusting plate may be adjusted according to the assembly condition of the outer fixing cup and the upper adjusting plate so as to improve the assembly accuracy, avoid looseness among components, improve the structure stability of the hinge, and ensure the use quality of the product.
2) By additionally adding the preload lug, a slip position of the preload lug relative to the bottom adjusting plate may be adjusted according to the assembly condition of the middle adjusting plate and the bottom adjusting plate so as to adjust the compactness and preload of connection between the middle adjusting plate and the bottom adjusting plate, improve the assembly accuracy, avoid noise caused by shaking between plates, enhance the use stability, and ensure the use effect of the product.
3) The upper adjusting plate is additionally provided with reinforcing bumps, and the upper adjusting plate is integrated with the crank in one piece, so the structure stability is greatly improved, the load-bearing strength is enhanced, the deformation probability is reduced, and the use effect of the product is ensured.
4) By means of the structure fit of the reinforcing convex ribs, reinforcing lugs and reinforcing rib part, the compressive strength of the structure is further enhanced, the deformation occurring in an opening or closing period or adjustment period is reduced, and the normal use of the hinge is ensured.

DETAILED DESCRIPTION OF THE INVENTION

The invention is further described below in combination with the drawings.

Figure 1:
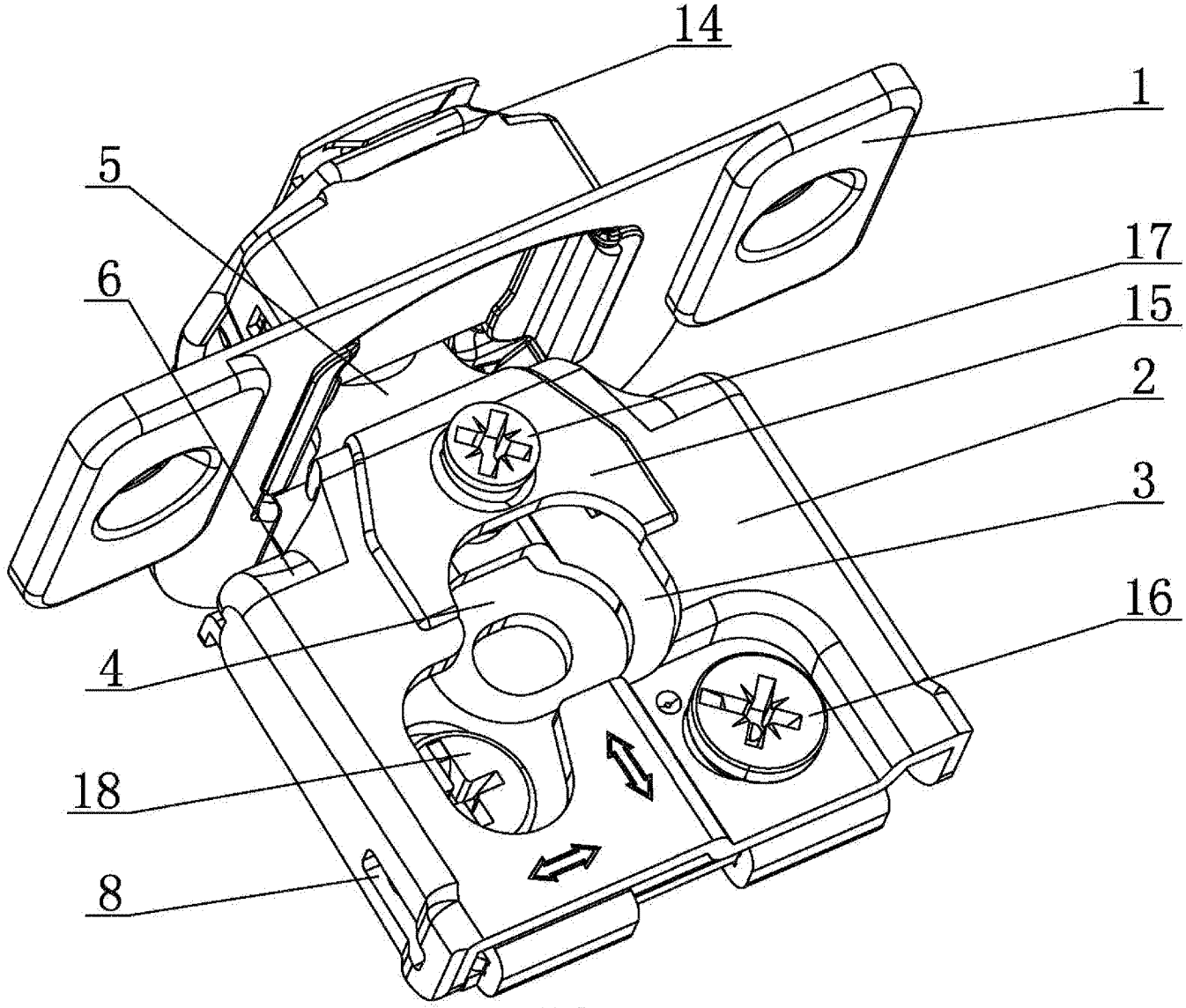
FIG. 1 is a structural schematic diagram of embodiment 1 of the invention.
Figure 2:
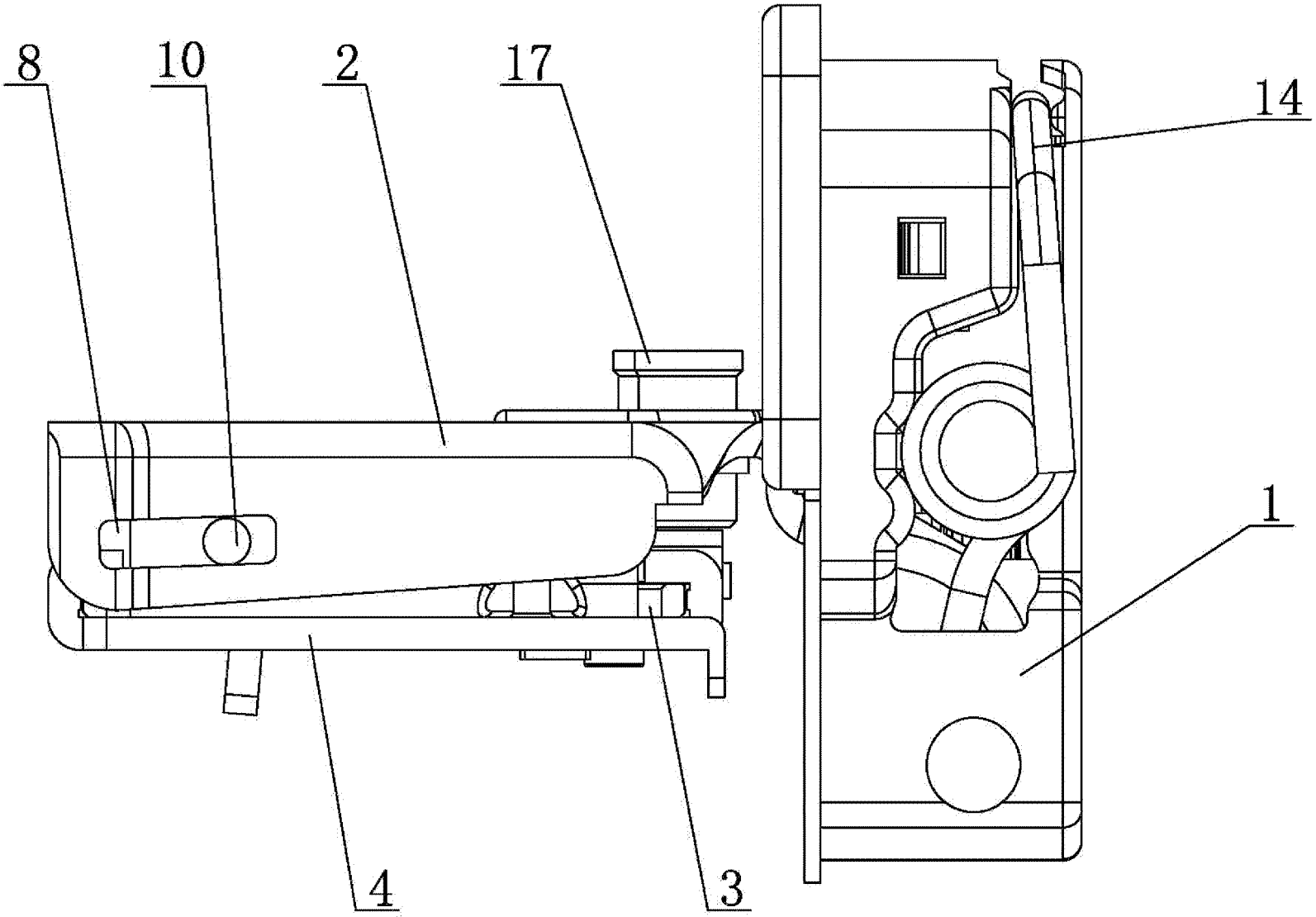
FIG. 2 is a main view of embodiment 1 of the invention.
Figure 3:
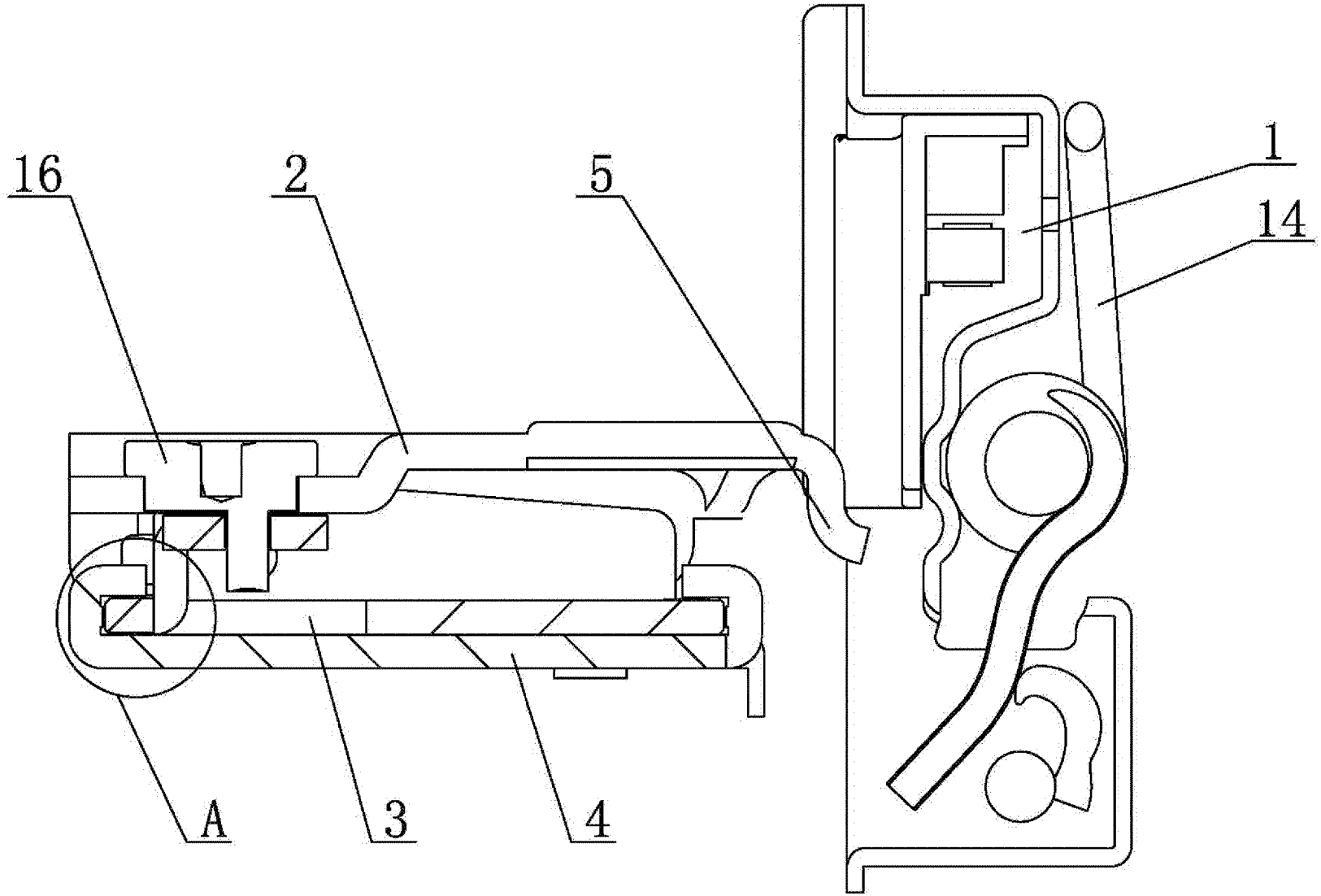
FIG. 3 is a local sectional view of embodiment 1 of the invention.
Figure 4:
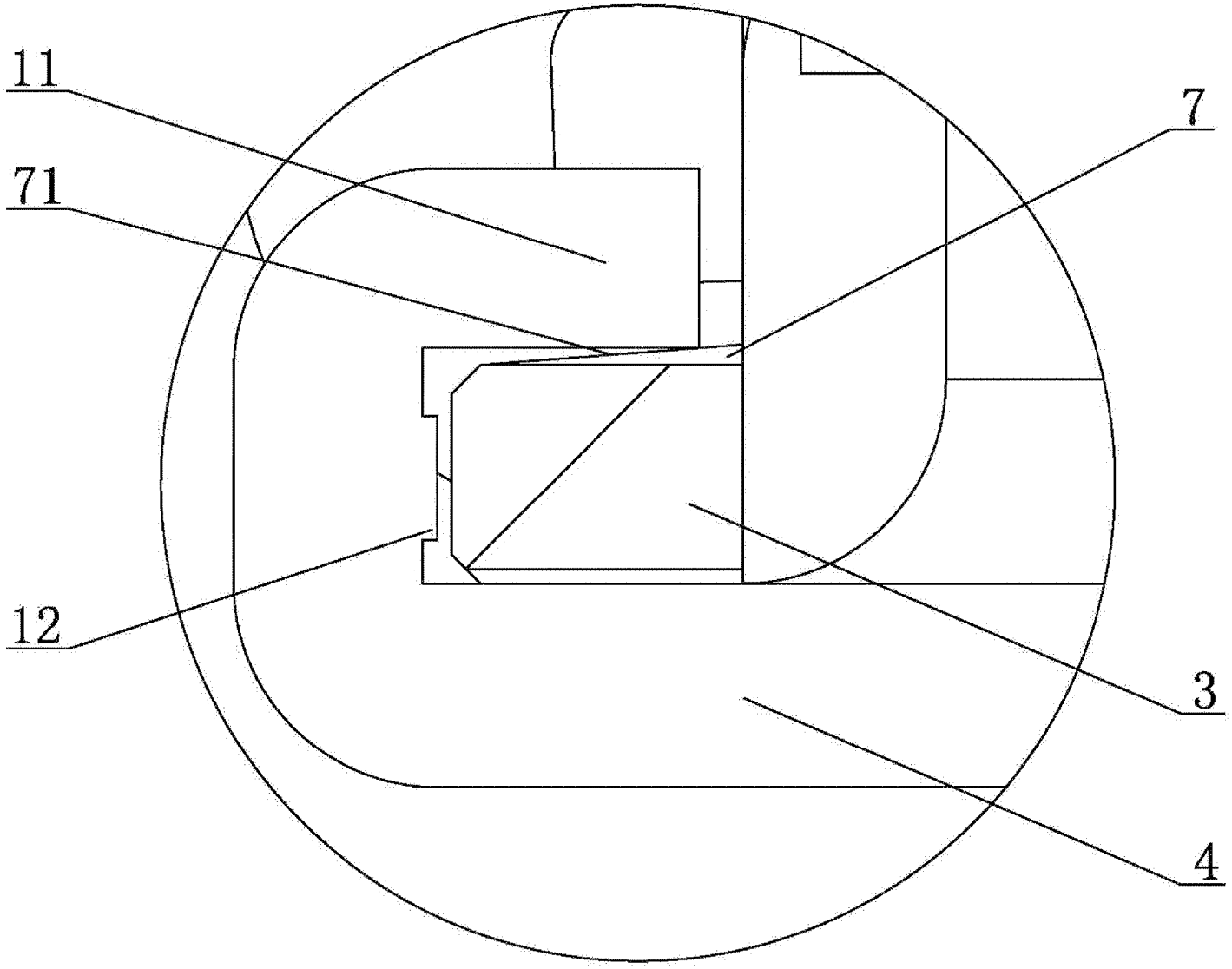
FIG. 4 is an enlarged view of A in FIG. 3 of embodiment 1 of the invention.
Figure 5:
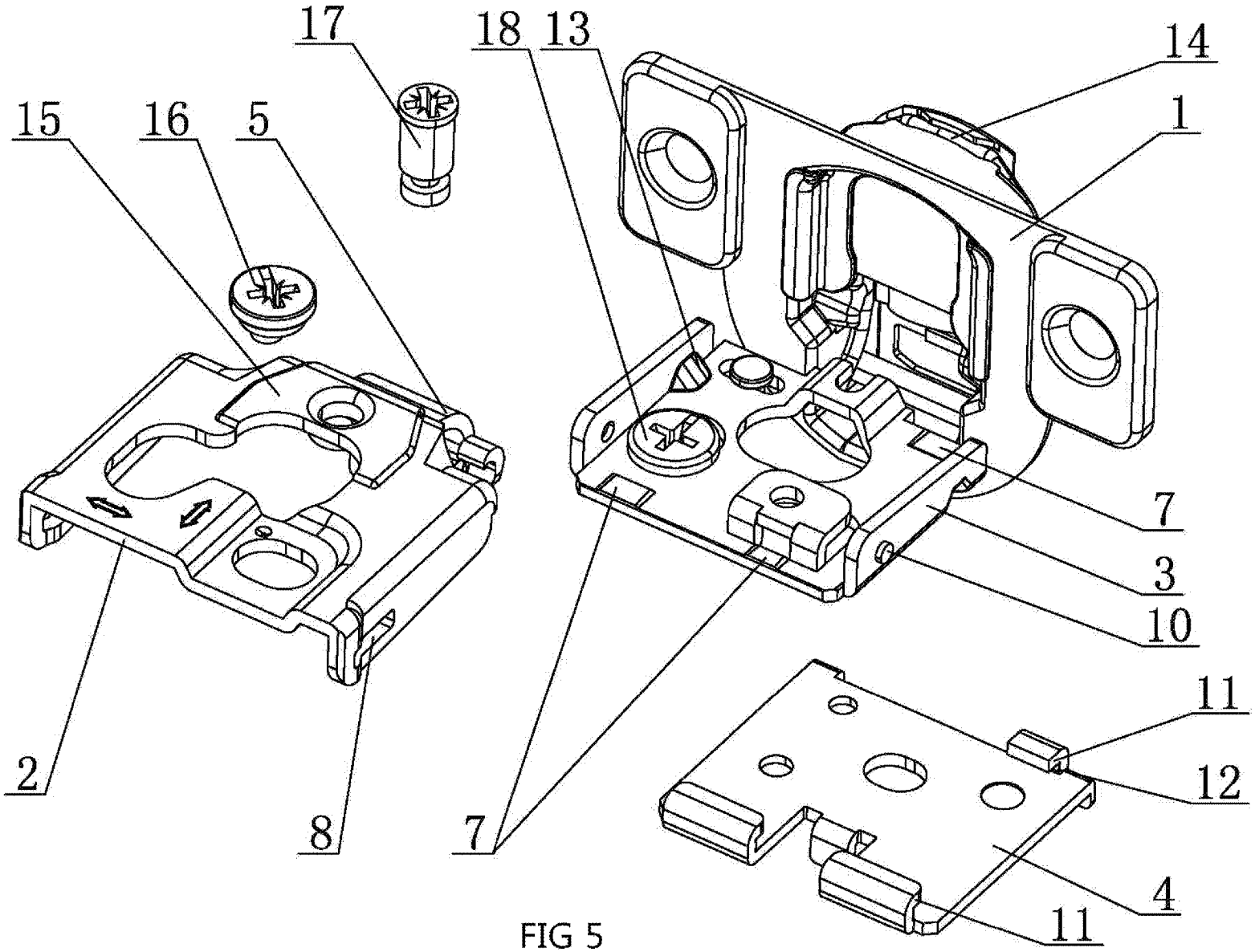
FIG. 5 is an exploded view of embodiment 1 of the invention.
Figure 6:
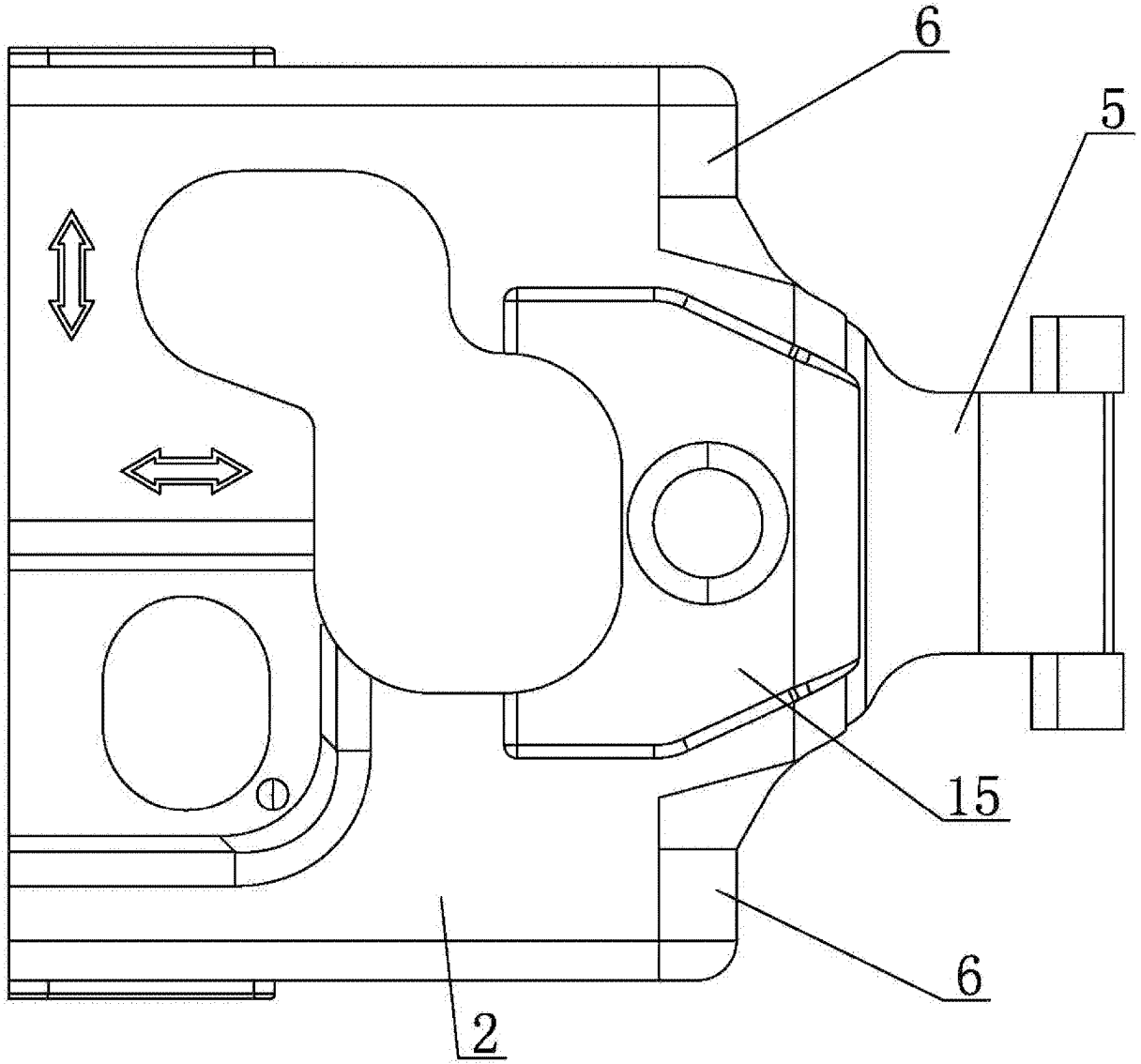
FIG. 6 is a top view of an upper adjusting plate of embodiment 1 of the invention.

As shown in FIG. 1 to FIG. 6, a multi-functional steam engine of the invention comprises an outer fixing cup 1 and an adjustment combination seat, the outer fixing cup 1 being hinged with the adjustment combination seat and opened or closed on the adjustment combination seat around a hinging position, wherein the adjustment combination seat comprises an upper adjusting plate 2, a middle adjusting plate 3 and a bottom adjusting plate 4 which are slidably connected in sequence.

The upper adjusting plate 2 is integrally formed with a crank 5 hinged with the outer fixing cup 1, and the upper adjusting plate 2 is provided with reinforcing bumps 6 located at two sides of the crank 5 and connected with the two sides of the crank 5. The structure stability is greatly improved, the load-bearing strength is enhanced, the deformation probability is reduced, and the use effect of the product is ensured.

In a practical application, the outer fixing cup 1 is provided with a spring 14, an elastic part of the spring 14 is sheathed on the outer fixing cup 1, both ends of the spring 14 are respectively connected at a hinging position of the crank 5 and the outer fixing cup 1, and the crank 5 is provided with a reinforcing rib part 15 extending from an upper end surface of the crank to an upper surface of the upper adjusting plate 2. The fracture of the crank 5 due to the elastic action of the spring 14 on the crank 5 is effectively avoided, the stability of connection between the crank 5 and the upper adjusting plate is improved, and the service life of the hinge is prolonged.

As shown in FIG. 1 to FIG. 6, the upper adjusting plate 2 is provided with an adjusting sliding connecting piece for adjusting a compactness of connection between the upper adjusting plate and the middle adjusting plate 3, and the adjusting sliding connecting piece is arranged at a connection between the upper adjusting plate 2 and the middle adjusting plate 3. Meanwhile, the middle adjusting plate 3 is provided with a preload lug 7 for adjusting a compactness of connection between the middle adjusting plate and the bottom adjusting plate 4, and the bottom adjusting plate 4 is slidably arranged on the middle adjusting plate 3 and is slidably connected with the preload lug 7.

During assembly, an adjusting direction of the adjusting sliding connecting piece is consistent with a sliding direction in which the middle adjusting plate 3 slides on the preload lug.

In this way, the adjusting sliding connecting piece is used so as to adjust the compactness of connection between the upper adjusting plate and the middle adjusting plate 3 and fit with a structure of the preload lug 7, so that a preload of connection between the middle adjusting plate 3 and the bottom adjusting plate 4 is adjusted, dimension errors among hinge components are effectively overcome, the assembly accuracy is improved, the use stability of the hinge is enhanced, and the use effect of the product is ensured.

As shown in FIG. 1 to FIG. 6, the adjusting sliding connecting piece comprises open inclined through grooves 8 and sliding blocks 10, wherein the open inclined through grooves 8 are arranged at a left side and a right side of the upper adjusting plate 2, and the sliding blocks 10 are arranged at a left side and a right side of the middle adjusting plate 3 and are slidably connected to the open inclined through grooves 8 along with a slip of the middle adjusting plate 3.

Moreover, a width of the open inclined through groove 8 is gradually narrowed in a direction approaching to the outer fixing cup 1.

That is, under the action of the open inclined through grooves 8, a compactness of connection between the upper adjusting plate 2 and the middle adjusting plate 3 may be adjusted according to the assembly condition of the outer fixing cup 1 and the upper adjusting plate 2 so as to enhance the preload, avoid looseness among components, improve the structure stability of the hinge, and ensure the use quality of the product.

As shown in FIG. 1 to FIG. 6, at least three preload lugs 7 are integrally formed on an upper surface of the middle adjusting plate 3 and each preload lug 7 is provided with a preload inclined plane 71 gradually inclined upwards from outside to inside, the bottom adjusting plate 4 is provided with a sliding grommet 11, the sliding grommet 11 is leftward or rightward connected to the middle adjusting plate 3 slidably, and an upper inside surface of the sliding grommet 11 is forward or backward connected to the preload inclined plane 71 slidably.

By means of the structure fit between the preload lug 7 and the sliding grommet 11, according to the assembly condition of connection between the middle adjusting plate 3 and the bottom adjusting plate 4, a slip position of the preload lug 7 relative to the bottom adjusting plate 4 is adjusted, so the sliding grommet 11 of the bottom adjusting plate 4 may slip in a direction of a highest point or lowest point of the preload inclined plane of the preload lug 7. The compactness of connection between the middle adjusting plate 3 and the bottom adjusting plate 4 is adjusted, the preload therebetween is strengthened, the assembly accuracy is improved, the noise caused by shaking between plates is avoided, the use stability is enhanced, and the use effect of the product is ensured.

At least three preload lugs 7 are integrally formed on an upper surface of the middle adjusting plate 3. One of the modes is shown in this solution, for example, three preload lugs 7 are present, one of the preload lugs 7 is arranged on an upper surface of the middle adjusting plate 3 close to the outer fixing cup 1, the other two preload lugs 7 are arranged on the upper surface of the middle adjusting plate 3 away from the outer fixing cup 1, so the three preload lugs 7 form a longitudinal adjustment preload surface. The adjustment stability is enhanced, and the compactness and preload between components are ensured.

As shown in FIG. 1 to FIG. 6, a front inside surface of the grommet 11 is provided with reinforcing lugs 12 slidably connected to the middle adjusting plate 3, and corner parts at the left side and the right side of the middle adjusting plate 3 are provided with reinforcing convex ribs 13.

Under the structure fit of the reinforcing convex ribs 13, reinforcing lugs 12 and reinforcing rib part 15, the compressive strength of the structure is further enhanced, the deformation occurring in an opening or closing period or adjustment period is reduced, and the normal use of the hinge is ensured.

As shown in FIG. 1 to FIG. 6, the middle adjusting plate 3 is provided with a forward-backward adjusting piece 16 for adjusting a forward or backward installation position of the upper adjusting plate 2 and adjusting a slip position relative to the adjusting sliding connecting piece and the preload lug 7, one end of the forward-backward adjusting piece 16 is eccentrically connected to the upper adjusting plate 2, and the other end of the forward-backward adjusting piece 16 is positioned on and connected to the middle adjusting plate 3.

That is, a forward or backward moving position of the middle adjusting plate 3 may be adjusted by only rotating the forward-backward adjusting piece 16, so the forward or backward installation position of the upper adjusting plate 2 relative to the outer fixing cup 1 is adjusted. Meanwhile, a slip position of the sliding block 10 in the open inclined through groove 8, a slip position of the upper inside surface of the sliding grommet 11 on the preload inclined plane 71 of the preload lug 7 are adjusted, to adjust the slip position relative to the inclined through groove 8 and the preload lug 7 while adjusting the forward or backward installation position of the upper adjusting plate 2. Due to convenient operation, the structure stability of the hinge is enhanced, the fit accuracy is improved, and the use quality of the product is ensured.

In addition, the middle adjusting plate 3 is provided with a height adjusting piece 17 for adjusting a height installation position of the upper adjusting plate 2, one end of the height adjusting piece 17 is positioned on and connected to the upper adjusting plate 2, and the other end of the height adjusting piece 17 is in threaded connection to the middle adjusting plate 3.

The middle adjusting plate 3 is provided with a leftward-rightward adjusting piece 18 for adjusting a leftward or rightward installation position relative to the bottom adjusting plate 4, one end of the leftward-rightward adjusting piece 18 is eccentrically connected to the middle adjusting plate 3, and the other end of the leftward-rightward adjusting piece 18 is positioned on and connected to the bottom adjusting plate 4.

At the height adjusting piece 17, the leftward-rightward adjusting piece 18 and the forward-backward adjusting piece 16, the assembly position of the outer fixing cup 1 and the adjustment combination seat is adjusted in multiple directions to improve the assembly accuracy, avoid noise caused by shaking occurring in product operation, improve the structure stability of the hinge, and ensure the use effect of the product.

Figure 7:
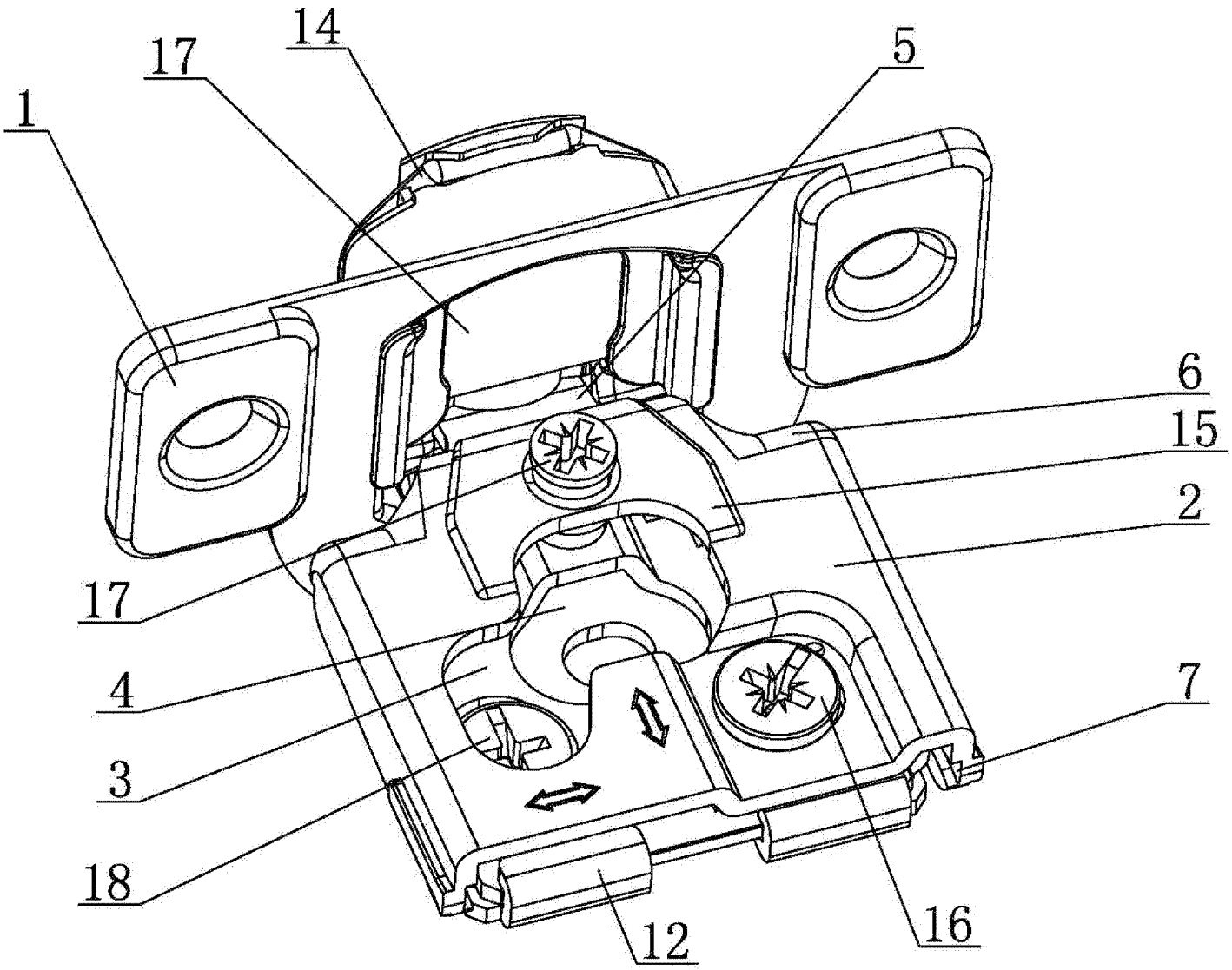
FIG. 7 is a structural schematic diagram of embodiment 2 of the invention.
Figure 8:
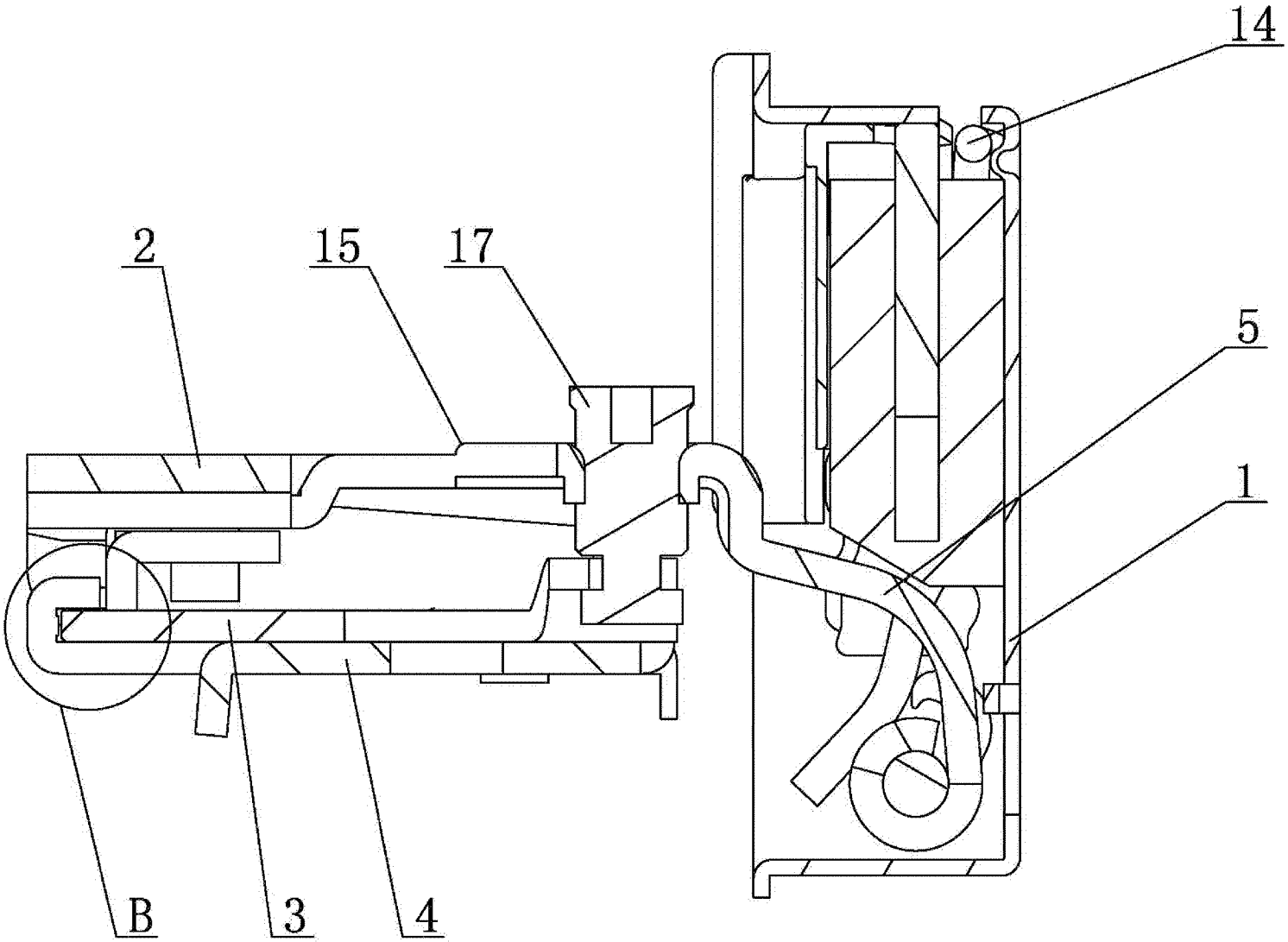
FIG. 8 is a sectional view of embodiment 2 of the invention.
Figure 9:
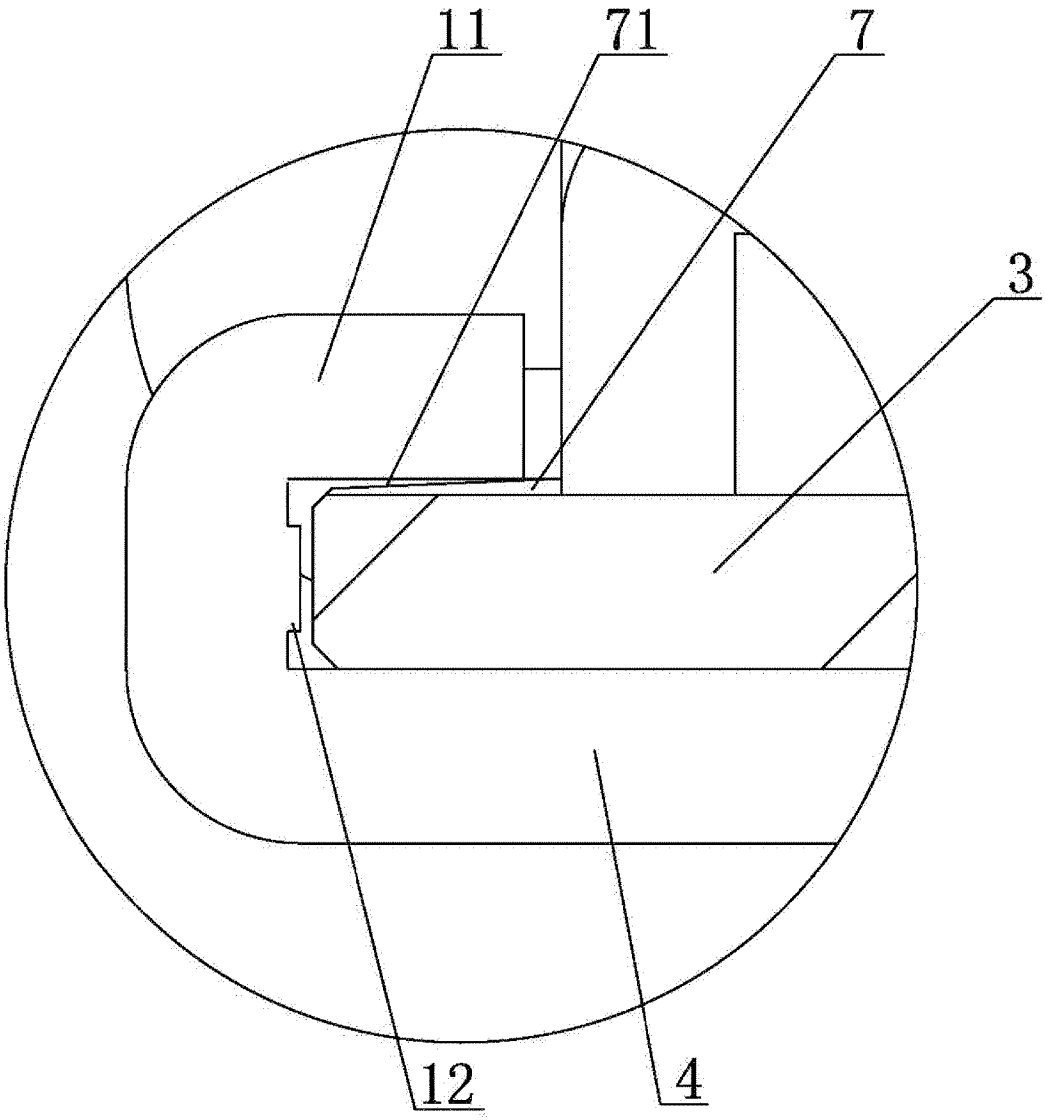
FIG. 9 is an enlarged view of B in FIG. 8 of embodiment 2 of the invention.
Figure 10:
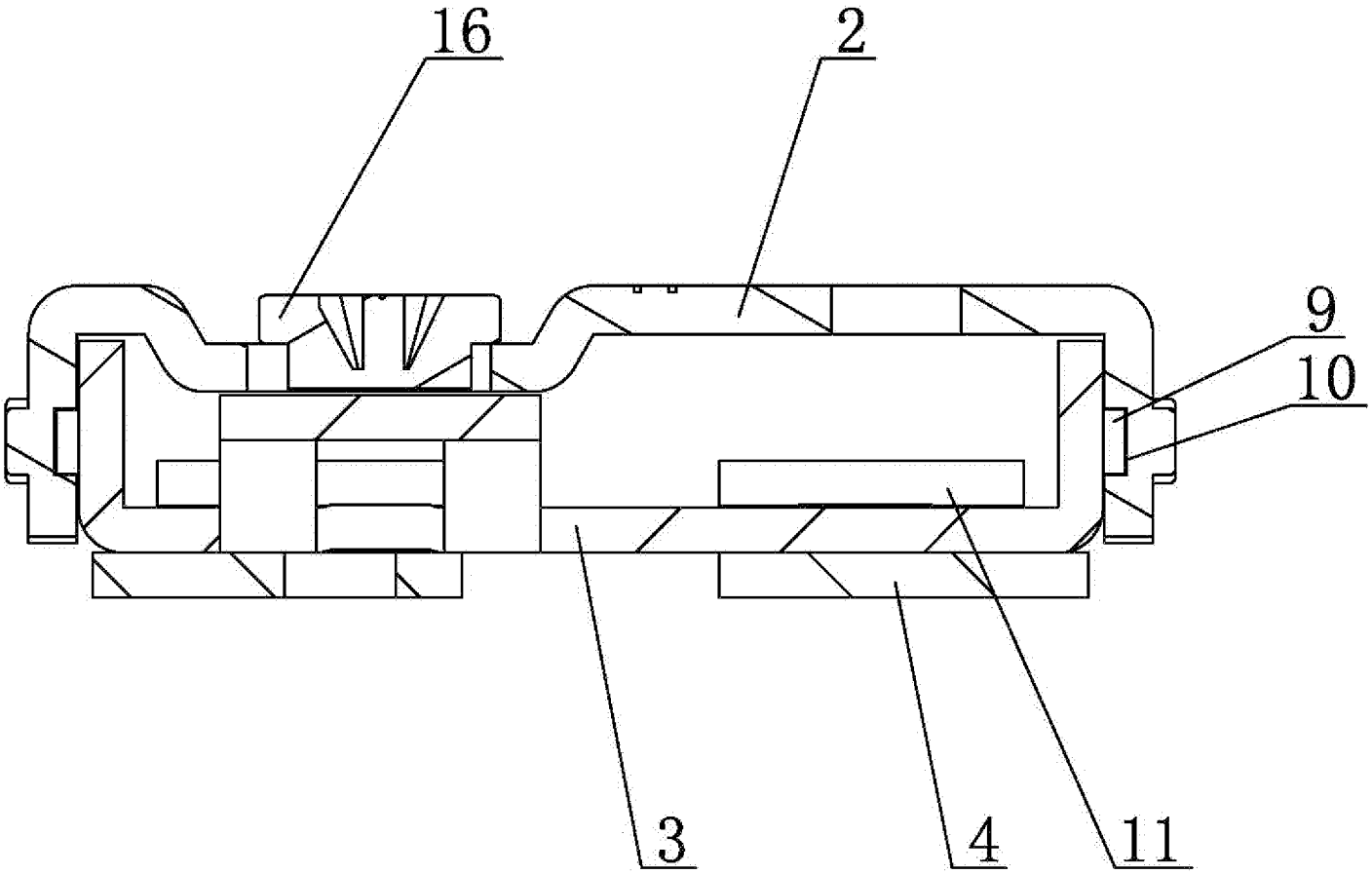
FIG. 10 is a sectional view of embodiment 2 of the invention viewed from another angle.
Figure 11:
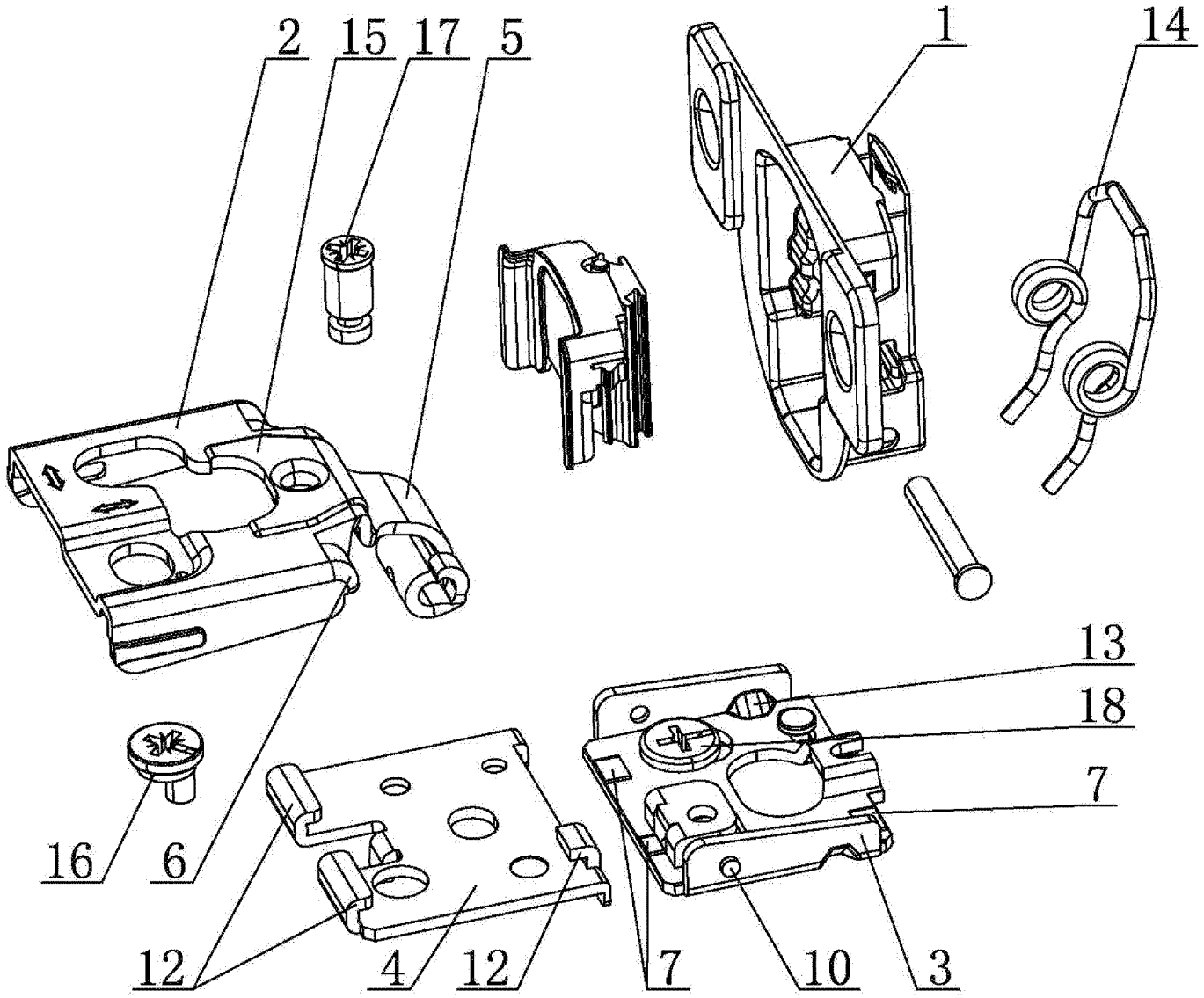
FIG. 11 is an exploded view of embodiment 2 of the invention.
Figure 12:
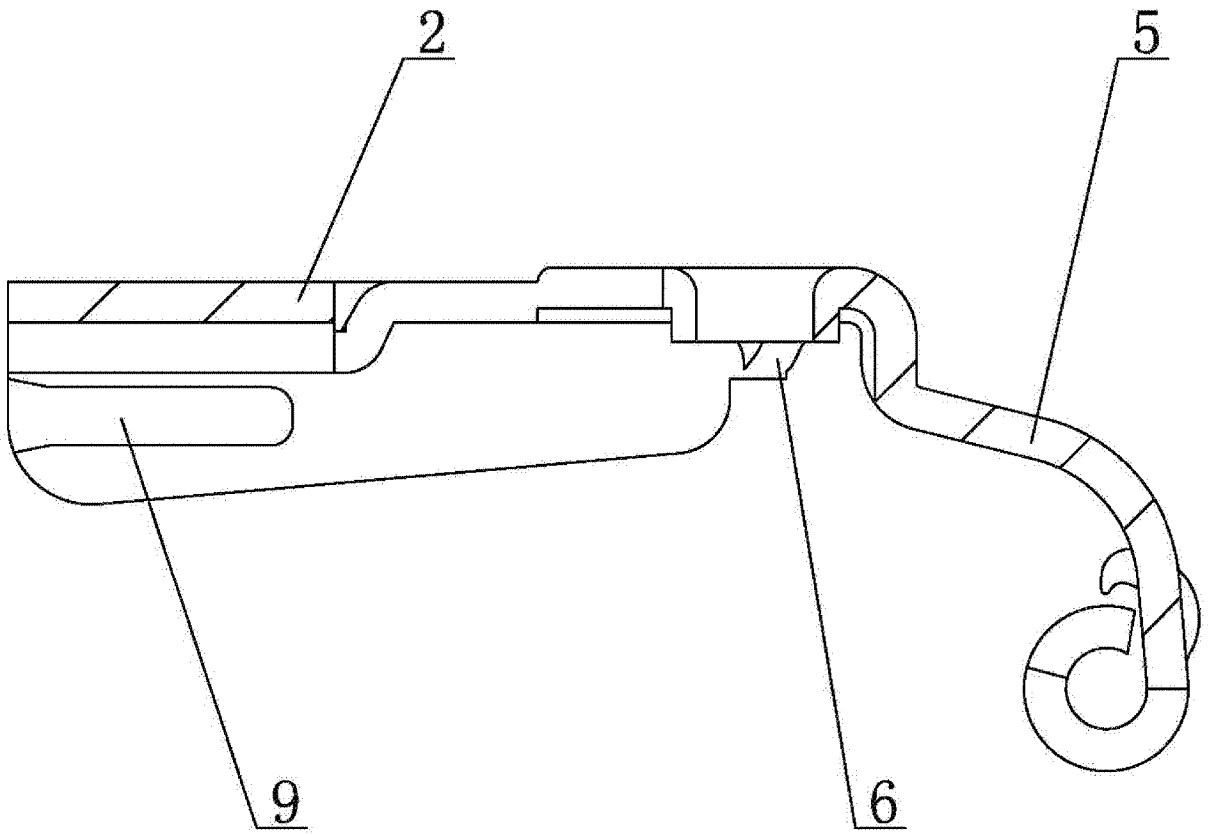
FIG. 12 is a sectional view of an upper adjusting plate of embodiment 2 of the invention.

As shown in FIG. 7 to FIG. 12, another embodiment is different from the above embodiment in that: the adjusting sliding connecting piece comprises inclined trenches 9 and sliding blocks 10, wherein the inclined trenches 9 are arranged at a left side and a right side of the upper adjusting plate 2, and the sliding blocks 10 are arranged at a left side and a right side of the middle adjusting plate 3 and are slidably connected to the inclined trenches 9 along with a slip of the middle adjusting plate 3. A width of the inclined trench 9 is gradually narrowed in a direction approaching to the outer fixing cup 1.

During assembly, a forward or backward moving position of the middle adjusting plate 3 may be adjusted by only rotating the forward-backward adjusting piece 16, so the forward or backward installation position of the upper adjusting plate 2 relative to the outer fixing cup 1 is adjusted. Meanwhile, the slip position of the inclined trench 9 of the sliding block 10 and the slip position of the upper inside surface of the sliding grommet 11 on the preload inclined plane 71 of the preload lug 7 are adjusted, to adjust the slip position relative to the inclined trench 9 and the preload lug 7 while adjusting the forward or backward installation position of the upper adjusting plate 2. Due to convenient operation, the compactness and preload of connection between the middle adjusting plate 3 and the bottom adjusting plate 4 are adjusted, the structure stability of the hinge is enhanced, the fit accuracy is improved, and the use quality of the product is ensured.

The above specific embodiments are only embodiments with good effects of the invention. Any structure identical or equivalent to that of the anti-deformation hinge with a preload adjustment function of the invention shall be covered in the protection scope of the invention.

The invention claimed is:

1. An anti-deformation hinge with a preload adjustment function, comprising:

an outer fixing cup (1) and an adjustment combination seat, the outer fixing cup (1) being hinged with the adjustment combination seat to from a hinging point and opened or closed on the adjustment combination seat around the hinging point, characterized in that: the adjustment combination seat comprises an upper adjusting plate (2), a middle adjusting plate (3) and a bottom adjusting plate (4) which are slidably connected in sequence, the upper adjusting plate (2) is integrally formed with a crank (5) hinged with the outer fixing cup (1), and the upper adjusting plate (2) is provided with reinforcing bumps (6) located at two sides of the crank (5) and connected to the two sides of the crank (5);

the upper adjusting plate (2) is provided with an adjusting sliding connecting piece for adjusting a compactness of connection between the upper adjusting plate and the middle adjusting plate (3), and the adjusting sliding connecting piece is arranged at a connection between the upper adjusting plate (2) and the middle adjusting plate (3);

the middle adjusting plate (3) is provided with at least one preload lug (7) for adjusting a compactness of connection between the middle adjusting plate and the bottom adjusting plate (4), and the bottom adjusting plate (4) is slidably arranged on the middle adjusting plate (3) and is slidably connected with the at least one preload lug (7).

2. The anti-deformation hinge with a preload adjustment function according to claim 1, characterized in that:

the adjusting sliding connecting piece comprises two open inclined through grooves (8) and two sliding blocks (10), wherein the two open inclined through grooves (8) are arranged at a left side and a right side of the upper adjusting plate (2), respectively, the two sliding blocks (10) are arranged at a left side and a right side of the middle adjusting plate (3), respectively, and each of the two sliding blocks (10) is slidably connected to an associated one of the two open inclined through grooves (8) to allow the upper adjusting plate (2) to be slidable along with the middle adjusting plate (3).

3. The anti-deformation hinge with a preload adjustment function according to claim 2, characterized in that:

the middle adjusting plate (3) is provided with at least three preload lugs (7), the at least three preload lugs (7) are integrally formed on an upper surface of the middle adjusting plate (3) and each of the at least three preload lugs (7) is provided with a preload inclined plane (71) gradually inclined upwards from outside to inside, the bottom adjusting plate (4) is provided with at least three sliding grommets (11), each of the at least three sliding grommets (11) is in a L-shape, each of the at least three sliding grommets (11) comprises a front inside surface and an upper inside surface, the front inside surface of each of the at least three sliding grommets (11) is connected to the upper surface of the bottom adjusting plate (4) faced toward to the middle adjusting plate (3), the upper inside surface of each of the at least three sliding grommets (11) is connected to the associated front inside surface and upwardly spaced from the upper surface of the bottom adjusting plate (4) faced toward to the middle adjusting plate (3), the middle adjusting plate (3) is in a U-shape, each of the at least three sliding grommets (11) is leftward or rightward connected to the middle adjusting plate (3) slidably, and the upper inside surface of each of the at least three sliding grommets (11) is forward or backward connected to the associated preload inclined plane (71) slidably.

4. The anti-deformation hinge with a preload adjustment function according to claim 3, characterized in that:

the front inside surface of each of the at least three sliding grommets (11) is provided with reinforcing lugs (12) slidably connected to the middle adjusting plate (3), and two corner parts at the left side and the right side of the middle adjusting plate (3) are provided with two reinforcing convex ribs (13), respectively, and the two reinforcing convex ribs (13) are located at an inside of the middle adjusting plate (3).

5. The anti-deformation hinge with a preload adjustment function according to claim 2, characterized in that:

a width of each of the two open inclined through grooves (8) is gradually narrowed in a direction approaching to the outer fixing cup (1).

6. The anti-deformation hinge with a preload adjustment function according to claim 5, characterized in that:

the middle adjusting plate (3) is provided with at least three preload lugs (7), the at least three preload lugs (7) are integrally formed on an upper surface of the middle adjusting plate (3) and each of the at least three preload lugs (7) is provided with a preload inclined plane (71) gradually inclined upwards from outside to inside, the bottom adjusting plate (4) is provided with at least three sliding grommets (11), each of the at least three sliding grommets (11) is in a L-shape, each of the at least three sliding grommets (11) comprises a front inside surface and an upper inside surface, the front inside surface of each of the at least three sliding grommets (11) is connected to an upper surface of the bottom adjusting plate (4) faced toward to the middle adjusting plate (3), the upper inside surface of each of the at least three sliding grommets (11) is connected to the associated front inside surface and upwardly spaced from the upper surface of the bottom adjusting plate (4) faced toward to the middle adjusting plate (3), the middle adjusting plate (3) is in a U-shape, each of the at least three sliding grommets (11) is leftward or rightward connected to the middle adjusting plate (3) slidably, and the upper inside surface of each of the at least three sliding grommets (11) is forward or backward connected to the associated preload inclined plane (71) slidably.

7. The anti-deformation hinge with a preload adjustment function according to claim 6, characterized in that:

the front inside surface of each of the at least three sliding grommets (11) is provided with reinforcing lugs (12) slidably connected to the middle adjusting plate (3), and two corner parts at the left side and the right side of the middle adjusting plate (3) are provided with two reinforcing convex ribs (13), respectively, and the two reinforcing convex ribs (13) are located at an inside of the middle adjusting plate (3).

8. The anti-deformation hinge with a preload adjustment function according to claim 1, characterized in that:

the adjusting sliding connecting piece comprises two inclined trenches (9) and two sliding blocks (10), wherein the two inclined trenches (9) are arranged at a left side and a right side of the upper adjusting plate (2), respectively, and the two sliding blocks (10) are arranged at a left side and a right side of the middle adjusting plate (3), respectively, and each of the two sliding blocks (10) is slidably connected to an associated one of the two inclined trenches (9) to allow the upper adjusting plate (2) to be slidable along with the middle adjusting plate (3).

9. The anti-deformation hinge with a preload adjustment function according to claim 8, characterized in that:

a width of each of the two inclined trenches (9) is gradually narrowed in a direction approaching to the outer fixed cup (1).

10. The anti-deformation hinge with a preload adjustment function according to claim 9, characterized in that:

the middle adjusting plate (3) is provided with at least three preload lugs (7), the at least three preload lugs (7) are integrally formed on an upper surface of the middle adjusting plate (3) and each of the at least three preload lugs (7) is provided with a preload inclined plane (71) gradually inclined upwards from outside to inside, the bottom adjusting plate (4) is provided with at least three sliding grommets (11), each of the at least three sliding grommets (11) is in a L-shape, each of the at least three sliding grommets (11) comprises a front inside surface and an upper inside surface, the front inside surface of each of the at least three sliding grommets (11) is connected to an upper surface of the bottom adjusting plate (4) faced toward to the middle adjusting plate (3), the upper inside surface of each of the at least three sliding grommets (11) is connected to the associated front inside surface and upwardly spaced from the upper surface of the bottom adjusting plate (4) faced toward to the middle adjusting plate (3), the middle adjusting plate (3) is in a U-shape, each of the at least three sliding grommets (11) is leftward or rightward connected to the middle adjusting plate (3) slidably, and the upper inside surface of each of the at least three sliding grommets (11) is forward or backward connected to the associated preload inclined plane (71) slidably.

11. The anti-deformation hinge with a preload adjustment function according to claim 10, characterized in that:

the front inside surface of each of the at least three sliding grommets (11) is provided with reinforcing lugs (12) slidably connected to the middle adjusting plate (3), and two corner parts at the left side and the right side of the middle adjusting plate (3) are provided with two reinforcing convex ribs (13), respectively, and the two reinforcing convex ribs (13) are located at an inside of the middle adjusting plate (3).

12. The anti-deformation hinge with a preload adjustment function according to claim 8, characterized in that:

the middle adjusting plate (3) is provided with at least three preload lugs (7), the at least three preload lugs (7) are integrally formed on an upper surface of the middle adjusting plate (3) and each of the at least three preload lugs (7) is provided with a preload inclined plane (71) gradually inclined upwards from outside to inside, the bottom adjusting plate (4) is provided with at least three sliding grommets (11), each of the at least three sliding grommets (11) is in a L-shape, each of the at least three sliding grommets (11) comprises a front inside surface and an upper inside surface, the front inside surface of each of the at least three sliding grommets (11) is connected to an upper surface of the bottom adjusting plate (4) faced toward to the middle adjusting plate (3), the upper inside surface of each of the at least three sliding grommets (11) is connected to the associated front inside surface and upwardly spaced from the upper surface of the bottom adjusting plate (4) faced toward to the middle adjusting plate (3), the middle adjusting plate (3) is in a U-shape, each of the at least three sliding grommets (11) is leftward or rightward connected to the middle adjusting plate (3) slidably, and the upper inside surface of each of the at least three sliding grommets (11) is forward or backward connected to the associated preload inclined plane (71) slidably.

13. The anti-deformation hinge with a preload adjustment function according to claim 12, characterized in that:

the front inside surface of each of the at least three sliding grommets (11) is provided with reinforcing lugs (12) slidably connected to the middle adjusting plate (3), and two corner parts at the left side and the right side of the middle adjusting plate (3) are provided with two reinforcing convex ribs (13), respectively, and the two reinforcing convex ribs (13) are located at an inside of the middle adjusting plate (3).

14. The anti-deformation hinge with a preload adjustment function according to claim 1, characterized in that:

an adjusting direction of the adjusting sliding connecting piece is consistent with a sliding direction in which the bottom adjusting plate (4) slides on the at least one preload lug (7).

15. The anti-deformation hinge with a preload adjustment function according to claim 14, characterized in that:

the middle adjusting plate (3) is provided with at least three preload lugs (7), the at least three preload lugs (7) are integrally formed on an upper surface of the middle adjusting plate (3) and each of the at least three preload lugs (7) is provided with a preload inclined plane (71) gradually inclined upwards from outside to inside, the bottom adjusting plate (4) is provided with at least three sliding grommets (11), each of the at least three sliding grommets (11) is in a L-shape, each of the at least three sliding grommets (11) comprises a front inside surface and an upper inside surface, the front inside surface of each of the at least three sliding grommets (11) is connected to an upper surface of the bottom adjusting plate (4) faced toward to the middle adjusting plate (3), the upper inside surface of each of the at least three sliding grommets (11) is connected to the associated front inside surface and upwardly spaced from the upper surface of the bottom adjusting plate (4) faced toward to the middle adjusting plate (3), the middle adjusting plate (3) is in a U-shape, each of the at least three sliding grommets (11) is leftward or rightward connected to the middle adjusting plate (3) slidably, and the upper inside surface of each of the at least three sliding grommets (11) is forward or backward connected to the associated preload inclined plane (71) slidably.

16. The anti-deformation hinge with a preload adjustment function according to claim 15, characterized in that:

the front inside surface of each of the at least three sliding grommets (11) is provided with reinforcing lugs (12) slidably connected to the middle adjusting plate (3), and two corner parts at the left side and the right side of the middle adjusting plate (3) are provided with two reinforcing convex ribs (13), respectively, and the two reinforcing convex ribs (13) are located at an inside of the middle adjusting plate (3).

17. The anti-deformation hinge with a preload adjustment function according to claim 1, characterized in that:

the middle adjusting plate (3) is provided with at least three preload lugs (7), the at least three preload lugs (7) are integrally formed on an upper surface of the middle adjusting plate (3) and each of the at least three preload lugs (7) is provided with a preload inclined plane (71) gradually inclined upwards from outside to inside, the bottom adjusting plate (4) is provided with at least three sliding grommets (11), each of the at least three sliding grommets (11) is in a L-shape, each of the at least three sliding grommets (11) comprises a front inside surface and an upper inside surface, the front inside surface of each of the at least three sliding grommets (11) is connected to the upper surface of the bottom adjusting plate (4) faced toward to the middle adjusting plate (3), the upper inside surface of each of the at least three sliding grommets (11) is connected to the associated front inside surface and upwardly spaced from the upper surface of the bottom adjusting plate (4) faced toward to the middle adjusting plate (3), the middle adjusting plate (3) is in a U-shape, each of the at least three sliding grommets (11) is leftward or rightward connected to the middle adjusting plate (3) slidably, and the upper inside surface of each of the at least three sliding grommets (11) is forward or backward connected to the associated preload inclined plane (71) slidably.

18. The anti-deformation hinge with a preload adjustment function according to claim 17, characterized in that:

the front inside surface of each of the at least three sliding grommets (11) is provided with reinforcing lugs (12) slidably connected to the middle adjusting plate (3), and two corner parts at the left side and the right side of the middle adjusting plate (3) are provided with two reinforcing convex ribs (13), respectively, and the two reinforcing convex ribs (13) are located at an inside of the middle adjusting plate (3).

19. The anti-deformation hinge with a preload adjustment function according to claim 1, characterized in that:

the outer fixing cup (1) is provided with a spring (14), the spring (14) is configures as a torsion spring, an elastic part of the spring (14) is sheathed on the outer fixing cup (1), both ends of the spring (14) are respectively connected at the hinging point formed between the crank (5) and the outer fixing cup (1), and the crank (5) is provided with a reinforcing rib part (15) extending from an upper end surface of the crank to an upper surface of the upper adjusting plate (2).

20. The anti-deformation hinge with a preload adjustment function according to claim 1, characterized in that:

the middle adjusting plate (3) is provided with a forward-backward adjusting piece (16) for adjusting a forward or backward installation position of the upper adjusting plate (2) and adjusting a position of the middle adjusting plate (3) slidable relative to the upper adjusting plate (2), one end of the forward-backward adjusting piece (16) is eccentrically connected to the upper adjusting plate (2), and the other end of the forward-backward adjusting piece (16) is positioned on and connected to the middle adjusting plate (3);

the middle adjusting plate (3) is provided with a height adjusting piece (17) for adjusting a height installation position of the upper adjusting plate (2), one end of the height adjusting piece (17) is in threaded connection to the upper adjusting plate (2), and the other end of the height adjusting piece (17) is engaged with a groove defined on the middle adjusting plate (3);

the middle adjusting plate (3) is provided with a leftward-rightward adjusting piece (18) for adjusting a leftward or rightward installation position relative to the bottom adjusting plate (4), one end of the leftward-rightward adjusting piece (18) is eccentrically connected to the middle adjusting plate (3), and the other end of the leftward-rightward adjusting piece (18) is positioned on and connected to the bottom adjusting plate (4).

* * * * *